US007009914B2

(12) United States Patent
Higuchi et al.

(10) Patent No.: US 7,009,914 B2
(45) Date of Patent: Mar. 7, 2006

(54) ELECTRONIC CLOCK

(75) Inventors: Haruhiko Higuchi, Saitama (JP); Akiyoshi Murakami, Saitama (JP); Motoki Funahashi, Tokyo (JP)

(73) Assignee: Citizen Watch Co., Ltd., tokyo (JP)

( * ) Notice: Subject to any disclaimer, the term of this patent is extended or adjusted under 35 U.S.C. 154(b) by 0 days.

(21) Appl. No.: 10/525,988

(22) PCT Filed: Aug. 29, 2003

(86) PCT No.: PCT/JP03/11072

§ 371 (c)(1),
(2), (4) Date: Mar. 1, 2005

(87) PCT Pub. No.: WO2004/029734

PCT Pub. Date: Apr. 8, 2004

(65) Prior Publication Data

US 2005/0249047 A1 Nov. 10, 2005

(30) Foreign Application Priority Data

Sep. 26, 2002 (JP) ..... 2002-280948

(51) Int. Cl.
*G04B 1/00* (2006.01)
*G04B 9/00* (2006.01)
*G04C 3/00* (2006.01)

(52) U.S. Cl. ..... 368/64; 368/66; 368/204

(58) Field of Classification Search ..... 368/64, 368/66, 203–205
See application file for complete search history.

(56) References Cited

U.S. PATENT DOCUMENTS 5,835,457 A * 11/1998 Nakajima ..... 368/204
6,580,665 B1 * 6/2003 Kamiyama et al. ..... 368/66
6,646,960 B1 * 11/2003 Nagata ..... 368/204
2002/0154575 A1 10/2002 Fujita et al.

FOREIGN PATENT DOCUMENTS

WO WO-02/23285 3/2002

* cited by examiner

*Primary Examiner*—Vit W. Miska
(74) *Attorney, Agent, or Firm*—Dickstein Shapiro Morin & Oshinsky LLP

(57) ABSTRACT

In detecting power generation of an electronic timepiece having a conventional power generating unit, voltage output by the power generating unit is limited by output from a storage unit since the power generating unit and the storage means are connected when the power generation state is detected, and voltage equal to or larger than voltage output from the storage unit cannot be detected. An electronic timepiece is provided which can overcome the problem and can check an operation of the power generating unit securely irrespective of the state of the storage means.

In an electronic timepiece driven by power stored from a power generating unit (1) into a storage unit (4), the electronic timepiece includes a power generation detecting unit (2) that detects a power generation state of the power generating unit (1) and a switch unit (7) that separates the power generating unit (1) and the storage unit (4) when the power generation state of the power generating unit (1) is detected. In this case, the switch (7) between the power generating unit (1) and the storage unit (4) is controlled to OFF so that the output from the power generating unit (1) cannot be limited by the output from the storage unit (4).

5 Claims, 3 Drawing Sheets

ELECTRONIC CLOCK

TECHNICAL FIELD

The invention relates to an electronic timepiece having a power generating unit and being driven by power generated by the power generating unit, and, more specifically, it relates to a technology for detecting a power generation state of the power-generating unit and informing the detection result.

BACKGROUND ART

In recent years, electronic timepieces each of which includes a power generating unit for saving efforts of battery changes required in conventional electronic timepieces to enhance the convenience of users and which is driven by power generated by the power generating unit have been developed and commercially available.

In an electronic timepiece including a power generating unit, whether the power generating unit is normally operating or not, whether a path for feeding power generated by the power generating unit to the electronic timepiece is securely connected or not, and so on must be checked in production steps in order to secure basic operations as the power-generating timepiece.

Conventionally, for an electronic timepiece, a technology for outputting micropulses to a motor driver circuit based on a power generation detection signal from a power generation detecting unit in accordance with an operation by an external operating member has been proposed by the present applicant as a unit for performing such functional checks (see Patent Document 1, for example).

Patent Document 1:

WO 02/23285 A1 (Pages 7 to 10 and FIGS. 1 and 19)

The conventional technology will be described below with reference to FIG. 3 of the present application roughly showing a construction of detection of power generation of a power generating unit based on FIGS. 1 and 19 in Patent Document 1.

In the conventional example in FIG. 3, when a state is attained that an external operating member 56 such as the winding knob is pull out, the power generation state of a power generating unit 50 is detected by a power generation detecting unit 52. When the power generating unit 50 is at the power generation state, microcurrent is output from a micropulse generating unit 57 to a motor coil (not shown) through a motor driver circuit (not shown) A checker can check that the power generating unit 50 is generating power by detecting a change in magnetic field occurring in a motor coil upon output of microcurrent through the visual check of movement of an external device such as a second hand attached to a train (both of which are not shown) connecting to a motor or through a tester.

By using this technique, whether a power generating unit is normally operating in a finished timepiece or not and whether the power generating unit and the electronic timepiece are normally connected or not can be checked, and the most basic operations as a power generating timepiece can be secured easily.

Next, problems of the power generation detecting method in conventional examples will be described with reference to FIG. 3.

In a conventional example, the power generating unit 50 and a storage unit 54 are connected directly or through an anti-backflow diode 64. Generally, since the output impedance of the power generating unit 50 exhibits a higher value than that of the internal impedance of the storage unit 54, the voltage occurring across the storage unit 54 exhibits a substantially constant value in accordance with a voltage value output from the storage unit 54 irrespective of the presence of the power generation of the power generating unit 50.

Furthermore, as indicated in ( ) in FIG. 3, when the anti-backflow diode 64 is provided between the power generating unit 50 and the storage unit 54 and while the power generating unit 50 is not generating power, the voltage of the power generating unit 50 is zero (0). On the other hand, while the power generating unit 50 is generating power, the voltage, which is a sum of an amount of a drop in voltage caused when a current value caused when the power generating unit 50 generates power is fed to the anti-backflow diode 64 and a voltage value output from the storage unit 54, occurs across the power generating unit 50.

In both cases, voltage occurring across the power generating unit 50 depends on voltage output from the storage unit 54 and is originally a different value from that of the power generation voltage that the power generating unit 50 generates. According to the conventional technique, the presence of the connection of an electronic timepiece including the power generating unit 50 and storage unit 54 and whether power having a value equivalent to that of voltage output by the storage unit is generated or not could be checked, but whether the power generating unit 50 is generating the originally expected power generation voltage or not could not be checked.

In order to charge electric energy generated by the power generating unit 50 into the storage unit 54, the voltage generated by the power generating unit 50 must be larger than the voltage output from the storage unit 54. However, the storage unit 54 generally tends to have a potential increasing in accordance with an amount of stored power. Therefore, in order to have the storage unit 54 fully charged, the power generation voltage of the power generating unit 50 must be larger than the voltage output when the storage unit 54 is fully charged.

For measurement that satisfies the above-described requirements, an operation of detecting power generation must be performed by detaching the storage unit 54 or by fully charging the storage unit 54. However, in a process for manufacturing an electronic timepiece, the examinations under those states increase the number of man-hours and/or increase the manufacturing costs. In this way, for checking operations of the power generating unit 50, the conventional technology has problems that sufficient examinations cannot be performed or that a large amount of efforts is required for performing sufficient examinations.

It is an object of the invention is to provide an electronic timepiece, which can overcome the above-described defects and can securely check operations of a power generating unit irrespective of the state of a power storage unit.

DISCLOSURE OF THE INVENTION

In order to achieve the object, the principle of an electronic timepiece according to the invention is as follows.

In an electronic timepiece driven by electric energy generated by a power generating unit, the electric timepiece includes a storage unit connected with the power generating unit in parallel through an electronic switch, a control unit that controls the electronic switch, a power generation detecting unit that detects a power generation state of the power generating unit, an informing unit that informs a detection result of the power generation detecting unit to the outside, and an external operating member. In this case, the external operating member is operated so that the power generation detecting unit can go into action while a power generation detecting operation is performed under a condition that the electronic switch is turned off by the control unit and the result is informed to the outside through the informing unit. Thus, an electronic timepiece can be provided which can check an operation of the power generating unit securely irrespective of the state of the storage unit. Furthermore, whether the power generation state of the power generating unit at a predetermined power generation state satisfies a desired value or not can be examined simply and with stability.

Furthermore, a first resistor and second resistor and second electronic switch unit, which are connected in series, are connected to the power generating unit in parallel, the second electronic switch unit is controlled to ON at the same time that the power generation detecting unit goes into action through the external operating member, and in that the input of the power generation detecting unit is connected at the midpoint between the first resistor and the second resistor. The division of voltage by the first resistor and second resistor allows the detection of power generation voltage generated by the power generating unit, which is equal to or larger than voltage output from the storage unit.

Furthermore, in an electronic timepiece driven by electric energy generated by a power generating unit, the electric timepiece includes a first storage unit connected with the power generating unit in parallel, a second storage unit connected with the power generating unit in parallel through an electronic switch, a control unit that controls the electronic switch, a power generation detecting unit that detects a power generation state of the power generating unit, an informing unit that informs a detection result of the power generation detecting unit to the outside, and an external operating member. In this case, the external operating member is operated so that the power generation detecting unit can go into action while a power generation detecting operation is performed under a condition that the electronic switch is turned off by the control unit and the result is informed to the outside through the informing unit. Thus, even after the electronic switch is turned OFF, the voltage detecting unit can operate by using charges stored in the first storage unit, and stable detection of power generation can be performed thereby.

The first storage unit has a smaller amount of stored power than that of the second storage unit. Thus, a simple and temporary storage unit such as a capacitor can be used as the first storage unit.

Furthermore, the power generation detecting unit detects a power generation state of the power generating unit by detecting voltage of the first storage unit. Thus, voltage of the voltage detecting unit can be detected by using charges stored in the first storage unit, and stable detection of power generation can be performed thereby.

BEST MODE FOR CARRYING OUT THE INVENTION

Figure 1:
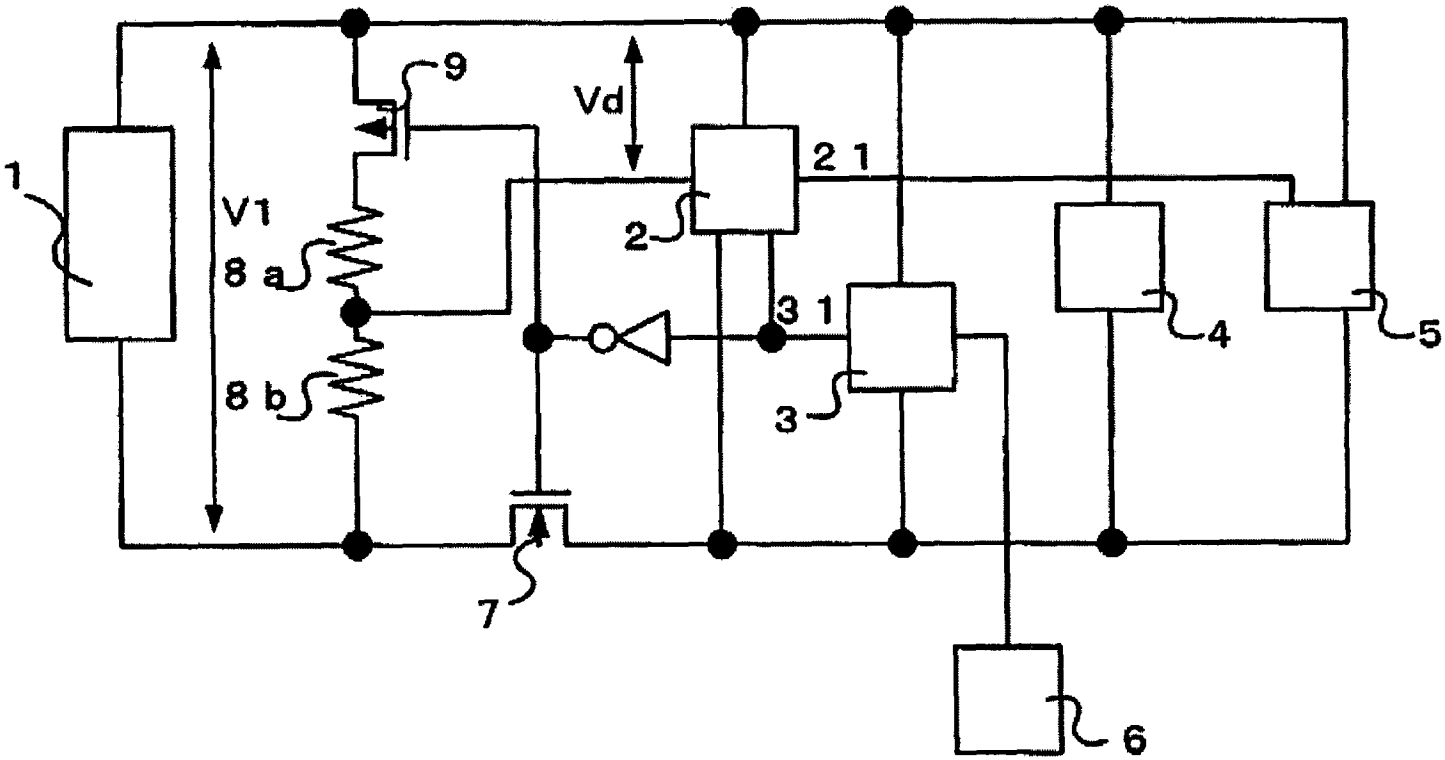
FIG. 1 is a partial block diagram of an electronic timepiece showing a first example of the invention.

An embodiment of the invention will be described below in detail with reference to drawings. FIG. 1 is a partial block diagram of an electronic timepiece indicating a first example of the invention.

FIG. 1 includes a power generating unit 1, a power generation detecting unit 2, a control circuit 3, a storage unit 4, an informing unit 5, an external operating member 6, an n-channel transistor (electronic switch) 7, a first resistor 8*a*, a second resistor 8*b*, and a p-channel transistor (second electronic switch unit) 9. In this embodiment, parts relating to a timepiece among construction elements relating to an electronic timepiece such as an oscillator circuit, frequency divider circuit, motor driver circuit and motor in a needle-driven electronic timepiece, for example, are omitted. These components of the electronic timepiece operate by using power from the storage unit 4 according to this embodiment.

When the external operating member 6 is operated and a power generation detecting state is attained thereby, a control signal 31 from the control unit 3 exhibits H, and the power generation detecting unit 2 goes into action. Furthermore, the n-channel transistor 7 is turned off since the gate is turned to L through an inverter 32. Furthermore, the p-channel transistor 9 is turned on since the gate is turned to L through the inverter 32. When the power generating unit 1 is at the power generation state under this condition, power generation voltage V1 occurs across the power generating unit 1. The power generation voltage V1 is divided by the first resistor 8*a* and second resistor 8*b* and is input, as detection voltage Vd, to the power generation detecting unit 2.

The power generation detecting unit 2 compares the detection voltage Vd and predefined reference voltage Vr, and, if Vd>Vr, turns a power generation detecting signal 21 to H. When the power generation detecting signal 21 is turned to H, the informing unit 5 performs an operation for informing that the power generating unit 1 is at the power generation state to the outside.

Here, as a reference for determining whether the power generating unit 1 is at the power generation state or not, if the power generation voltage V1 exhibits a value equal to or larger than an maximum voltage value Vmax (such as a voltage value upon fully charged) that the storage unit 4 can output, the fact that the power generating unit 1 is operating normally can be determined. In this case, the value resulting from the division of the voltage value Vmax by the first resistor 8*a* and second resistor 8*b* may be defined as a reference signal Vr.

As described above, since voltage occurring in the power generating unit 1 can be detected independently from the voltage of the storage unit 4 according to this embodiment, a performance desired as a power generating timepiece can be secured in the simple way.

While the external operating member 6 and informing unit 5 are not specifically described in this embodiment, constructions thereof can be freely selected in accordance with a form and/or specification of an electronic timepiece. While, in the above-described Patent Document 1, the winding switch, push switch or the like may be used as the external operating member 6 and micropulses or the like output from a needle-driven motor may be used as the informing unit 5, these components can be apparently used to implement the operating member 6 and/or informing unit 5.

Similarly, the way of operating and controlling the power generation detecting unit 2 and so on, n-channel transistor 7 and p-channel transistor 9 in response to the operating member 6 can be selected as required. In other words, a form suitable for a user can be freely selected such as performing a power generation detecting operation only for a predetermined period of time after the external operating member 6 is operated.

According to the above-described first embodiment, since the control unit 3 and power generation detecting unit 2 are driven by voltage supplied from the storage unit 4, the power generation voltage V1 generated by the power generating unit 1 is divided by the resistor 8*a* and resistor 8*b* in order to detect voltage equal to or larger than voltage output from the storage unit 4. In other words, in the first example of the construction in FIG. 1, while the power generating unit 1 outputs V1, the power generation detecting unit 2 and control unit 3 operate at voltage (V4, for example) output by the storage unit 4.

If $V1 \leqq V4$, the power generation detecting unit 2 that measures V1 operates at voltage V4 higher than V1 and can therefore measure V1 directly.

However, if $V1 > V4$ (highly possible in the invention having the power generating unit 1 and the storage unit 4 separately), the power generation detecting unit 2 that is driven by V4 cannot directly measure V1 that is higher voltage than V4.

Therefore, V1 is resistance-divided by 8*a* and 8*b* such that voltage that is always measurable even when $V1 > V4$ (that is, $Vd \leqq V4$) can be measured.

However, the detecting method of the power generation detecting unit is not limited to the present method.

Figure 2:
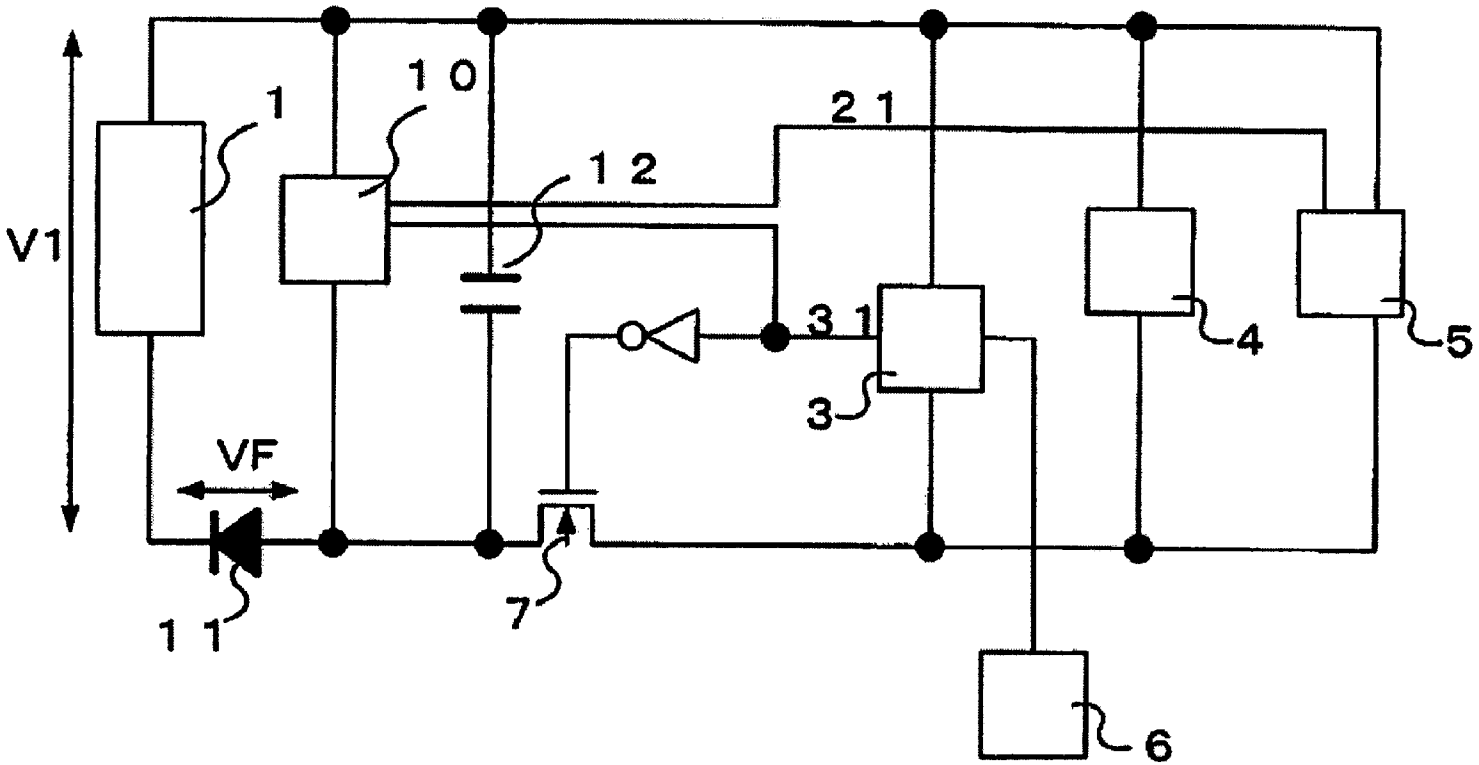
FIG. 2 is a partial block diagram of an electronic timepiece showing a second example of the invention.
Figure 3:
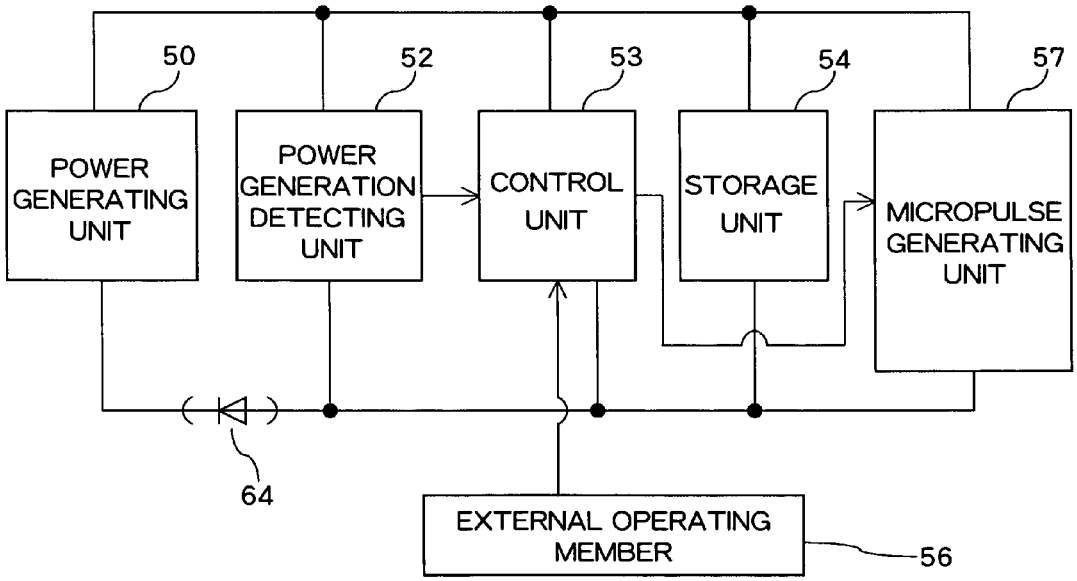
FIG. 3 is a partial block diagram of a conventional electronic timepiece having a power generating unit.

A second embodiment of the invention will be described below with reference to FIG. 2. The description on elements exhibiting the same details as those in FIG. 1 will be omitted. FIG. 2 is a block diagram showing a partial construction of an electronic timepiece of the second embodiment and includes a voltage detecting unit 10 that is a power generation detecting unit, a diode 11, and a capacitor (first storage unit) 12.

When the external operating member 6 is operated and the power generation detecting state is attained thereby, a control signal 31 from the control unit 3 exhibits H, and the voltage detecting unit 10 goes into action. Furthermore, the n-channel transistor 7 is turned off since the gate is turned to L through the inverter 32. When the capacitor 12 is detached from the storage unit 4 since the n-channel transistor 7 is turned off, current generated in the power generating unit 1 is fed into the capacitor 12 through the diode 11. Since the capacitor 12 has a lower capacitance than that of the storage unit 4, potentials there across rise in a shorter period of time. Thus, the voltage value is a value resulting from the subtraction of a voltage drop VF in the diode 11 from the power generation voltage V1 of the power generating unit 1.

The voltage detecting unit 10 turns a power generation detecting signal 21 to H when voltage input thereto is equal to or larger than predefined voltage. The informing unit 5 performs an operation for informing that the power generating unit 1 is at the power generation state to the outside when the power generation detecting signal 21 is turned to H.

Since the voltage detecting unit 10 used here is connected with the storage unit 4 in parallel when the n-channel transistor 7 is ON, the voltage detecting unit 10 can be also used for checking a storage state of the storage unit 4 such as whether voltage exceeds the rated voltage of the storage unit 4 or not.

The capacitor 12 is used for operating the voltage detecting unit 10 with stability when the storage unit 4 is detached therefrom, and the diode 11 plays a role in peak holding of power generation voltage from the power generating unit 1. In this case, both of the capacitor 12 and diode 11 are components for performing operations of this embodiment with stability.

When a small amount of power is generated by the power generating unit 1, for example, the voltage detecting unit 10 is cut off from power supply and is disabled without the capacitor 12 and diode 11.

When the capacitor 12 and diode 11 are connected thereto as shown in FIG. 2, the capacitor 12 is charged to the substantially same potential as that of the storage unit 4 immediately before the n-channel transistor 7 is turned off. Thus, even when the n-channel transistor 7 is turned off, the voltage detecting unit 10 can operate for a while with charges stored in the capacitor 12, and stable detection of power generation can be therefore performed irrespective of the presence of power generation.

The first resistor 8*a*, second resistor 8*b* and *p*-channel transistor 9 shown in the first example are not described and are omitted in the second example since a potential equal to or larger than power supply voltage of the power generation detecting unit 10 does not have to be detected because the power supply potential of the voltage detecting unit 10 varies in accordance with the potential output from the power generating unit 1 in the second embodiment. In other words, since the voltage detecting unit 10 is driven by voltage (V1+VF) of the capacitor 12 to be detected thereby in the second example having the construction in FIG. 2, the detection can be performed without resistance division.

As described above, according to the first and second examples, in an electronic timepiece including a power generating unit and being operated by electric energy generated by the power generating unit, whether a power generation state from the power generating unit at a predetermined power generation state satisfies a desired value or not can be examined in the simple way and with stability.

INDUSTRIAL APPLICABILITY

As described above, an electronic timepiece that is operated by electric energy generated by a power generating unit according to the invention can check an operation of the power generating unit with stability and simply, which can contribute to enhancement of the productivity.

What is claimed is:

1. An electronic timepiece driven by electric energy generated by power generating means, the electric timepiece characterized by comprising storage means connected with the power generating means in parallel through an electronic switch, control means that controls the electronic switch, power generation detecting means that detects a power generation state of the power generating means, informing means that informs a detection result of the power generation detecting means to the outside, and an external operating member, wherein the external operating member is operated so that the power generation detecting means can go into action while a power generation detecting operation is performed under a condition that the electronic switch is turned off by the control means and the result is informed to the outside through the informing means.

2. An electronic timepiece according to claim 1, characterized in that a first resistor and second resistor and second electronic switch means, which are connected in series, are connected to the power generating means in parallel, the second electronic switch means is controlled to ON at the same time that the power generation detecting means goes into action through the external operating member, and in that the input of the power generation detecting means is connected at the midpoint between the first resistor and the second resistor.

3. An electronic timepiece driven by electric energy generated by power generating means, the electric timepiece characterized by comprising first storage means connected with the power generating means in parallel, second storage means connected with the power generating means in parallel through an electronic switch, control means that controls the electronic switch, power generation detecting means that detects a power generation state of the power generating means, informing means that informs a detection result of the power generation detecting means to the outside, and an external operating member, wherein the power generation detecting means can go into action through the external operating member while a power generation detecting operation is performed under a condition that the electronic switch is turned off by the control means and the result is sent to the outside through the informing means.

4. An electronic timepiece according to claim 3, characterized in that the first storage means has a smaller amount of stored power than that of the second storage means.

5. An electronic timepiece according to claim 3 or 4, characterized in that the power generation detecting means detects a power generation state of the power generating means by detecting voltage of the first storage means.

* * * * *